US005320149A

United States Patent [19]

Peterson et al.

[11] Patent Number: 5,320,149

[45] Date of Patent: Jun. 14, 1994

[54] BOOM MOUNTED LOG SPLITTER

[75] Inventors: Arnold N. Peterson, Eugene; Larry A. Sprague, Pleasant Hill, both of Oreg.; John C. Lytle, Belfair, Wash.

[73] Assignee: Peterson Pacific Corp., Eugene, Oreg.

[21] Appl. No.: 17,647

[22] Filed: Feb. 12, 1993

[51] Int. Cl.[5] ..... B27L 7/00

[52] U.S. Cl. ..... 144/193 A; 144/193 R; 144/366; 144/3 D

[58] Field of Search ..... 144/3 D, 3 K, 34 E, 144/193 R, 193 A, 193 D, 366

[56] References Cited

U.S. PATENT DOCUMENTS

| | | | |
|---|---|---|---|
| 3,842,871 | 10/1974 | Jureiwicz | 144/193 A |
| 4,019,549 | 4/1977 | Williams | 144/193 A |
| 4,380,258 | 4/1983 | Hanser | 144/193 A |
| 4,501,309 | 2/1985 | Sinden | 144/193 A |
| 4,600,043 | 7/1986 | Chapman | 144/193 A |
| 4,615,367 | 10/1986 | Crowley, Jr. | 144/193 A |

*Primary Examiner*—W. Donald Bray
*Attorney, Agent, or Firm*—Robert L. Harrington

[57] ABSTRACT

An attachment configured and arranged for mounting onto the end of an articulated boom. The attachment preferably includes a grapple for handling and positioning whole logs under the articulated boom. A splitter blade extending from the structure is manipulated to engage and split the logs as the boom of the machine is retracted toward the machine through articulation.

7 Claims, 5 Drawing Sheets

BOOM MOUNTED LOG SPLITTER

FIELD OF THE INVENTION

This invention relates to an attachment to a boom on a materials handling machine and more particularly to a log splitter attachment for splitting full length logs.

BACKGROUND OF THE INVENTION

It is not uncommon to station a log chipper in the field, i.e., in the area where logs are being harvested. Logs are converted into chips on site and in the chip form are hauled more efficiently to pulp mills in large truck boxes. These field chippers are typically designed for efficient chipping of small diameter logs. A large diameter log, e.g., of eighteen inch diameter and larger, is not readily accommodated by the field chipper and requires special handling.

BRIEF DESCRIPTION OF THE INVENTION

The present invention is directed to the provision of a machine for lengthwise splitting of large diameter logs to facilitate the chipping process. In the preferred embodiment, a machine designed for back hoe digging provides the base component of the log splitting machine. The back hoe machine is typically a tractor having an articulated boom. A rearward facing bucket is mounted on the end of the boom and the bucket includes digging teeth. Hydraulic cylinders manipulate the boom and the bucket. In operation, the articulated boom is extended and the bucket teeth are directed into the ground. The boom then draws the bucket back toward he machine. An important feature of the back hoe is the power that is provided to the boom for forcing the bucket teeth into and along the ground, e.g., for digging ditches.

The attachment of the invention replaces the bucket on the back hoe machine and is manipulated by the same hydraulic cylinders. The attachment includes a splitting and slicing blade. In operation, a log is positioned so as to be extended outwardly from the machine. The positioned log is prevented from moving, e.g., one end of the log is butted against the machine body. The boom is extended over the log with the blade edge hooked over the outer end of the log. The blade is then drawn rearwardly through the log, the action being the same action applied when digging a trench with the back hoe bucket.

The attachment preferably includes a grapple and heel arrangement that enables the operator to pick up and position a log, the heel being provided by a claw that cooperates with the blade to enable the operator to also cut the log slices (or a whole log) to length. These and other features and benefits will become more clearly understood upon reference to the following detailed description and drawing.

DESCRIPTION OF THE PREFERRED EMBODIMENT

Figure 1:
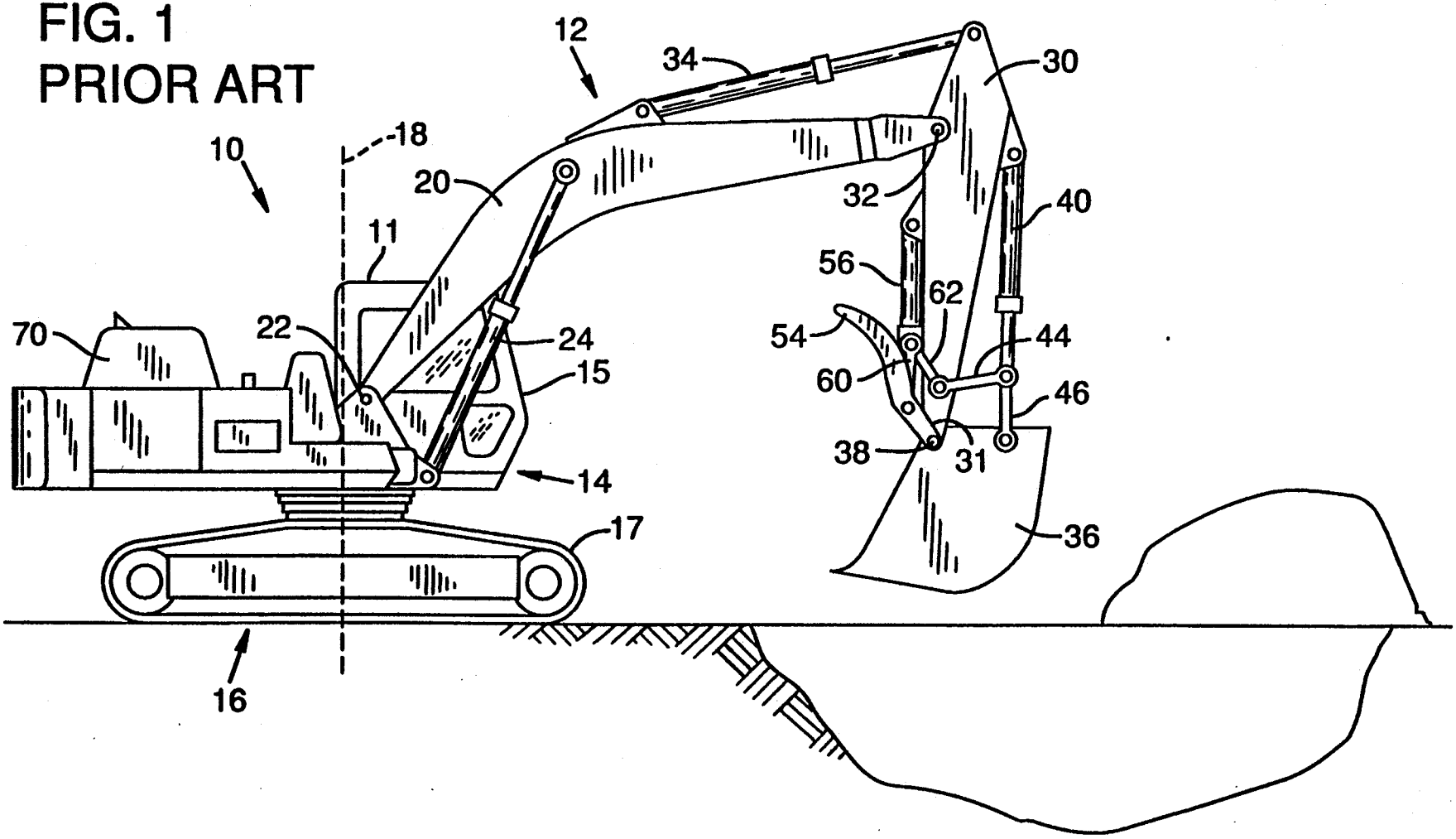
FIG. 1 PRIOR ART
FIG. 1 illustrates a back hoe machine of the prior art, being operated to dig a trench.

Refer now to FIG. 1 of the drawings which illustrates a material moving machine 10 often referred to as a back hoe. The machine 10 is of known construction, therefore only a brief description will be provided. The machine 10 has an articulated boom 12 extending from a base 14. The base 14 is mounted on a carriage 16 with the base arranged to be rotatable on the carriage about an axis 18. The boom 12 may thus be swung in a horizontal plane about axis 18. The base 14 is rotated relative to the carriage 16 by known power transmission apparatus (out of view). The carriage 16 includes crawler type tracks 17 to facilitate movement and steerage of the machine 10 with motive power being supplied to the tracks 17 in a known conventional manner. The articulated boom 12 has an end of a beam 20 pivotally mounted to the base 14 at 22. Dual cylinders (motors) 24 are provided to pivotally move the beam 20 relative to the base 14. A second beam 30 of the articulated boom 12 is pivotally mounted to the beam 20 at 32. A cylinder (motor) 34 is provided to pivotally move the beam 30 relative to the beam 20 about the pivotal connection 32. A bucket 36 is pivotally mounted on an end 31 of the beam 30 on shaft 38. A cylinder (motor) 40 in conjunction with paired control arms 44, 46 are provided to pivotally move the bucket 36 about the pivotal mount 38. A heel rack 54 is pivotally mounted on the end of the beam 30 opposite the bucket 36 on shaft 38 and is moveable by a cylinder (motor) 56 in conjunction with paired control arms 60, 62.

An operator's compartment 11 is provided on the base 14 and includes a control station 15 (out of view) to control the operation of the machine 10. The machine 10 is thus arranged for the controlled movement of the articulated boom 12, the rotation of the base 14 on the carriage 16 and the movement of the machine 10 relative to the ground. Movement of the above components (boom, base rotation and machine movement) either individually or in conjunction with each other provide for the controlled movement of the end 31 of the boom 12. The end 31 thus may be elevated and lowered, extended and retracted relative to the base 14, may be swung about axis 18 and may also be moved by movement of machine 10. In addition, the bucket 36 and/or the heel rack 54 and the like are individually controllable.

A conventional power supply unit 70 supplies motive power to the machine 10. Suitable control sets (illustrated in the block diagram of FIG. 4 and later described) are provided for controlling the function of the components of the machine 10. The control sets are arranged so that each component controlled may be moved or controlled independently or in conjunction with other components. The control sets are operable by the operator at the control station 15.

The machine 10 of FIG. 1 is illustrated digging a trench and the controlled movements of the components of the machine 10 are employed to accomplish the task.

Figure 2:
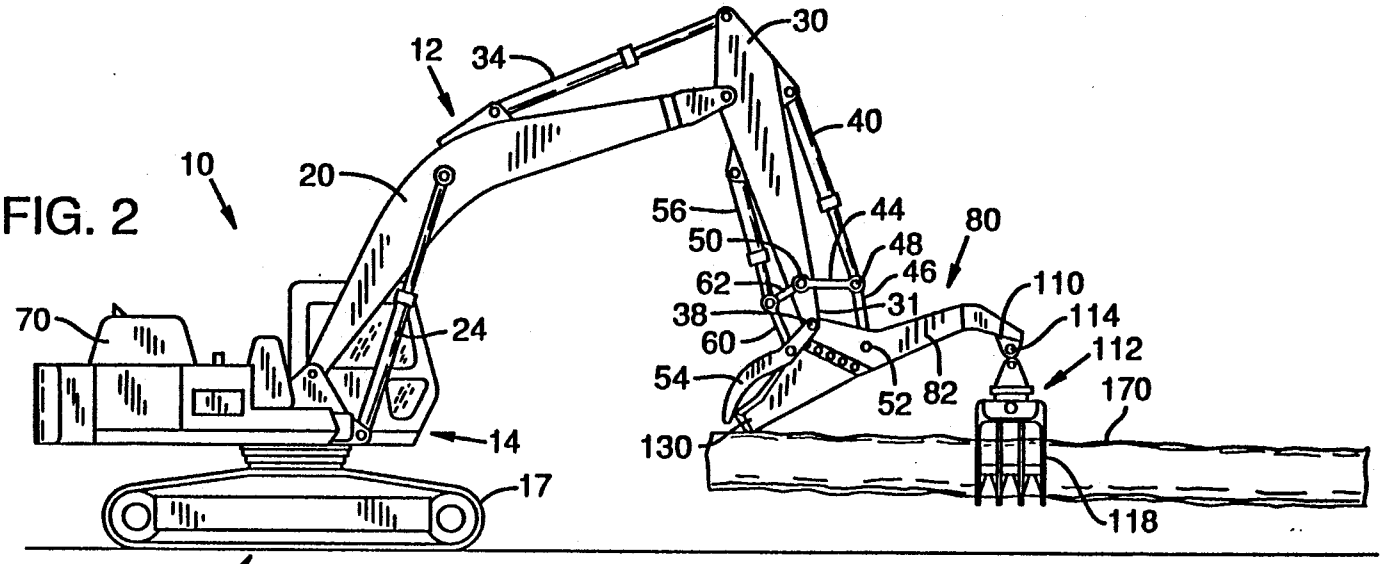
FIG. 2 illustrates the same basic machine of FIG. 1 with the bucket portion replaced with an attachment in accordance with the present invention and positioning a log to be split.
Figure 3A:
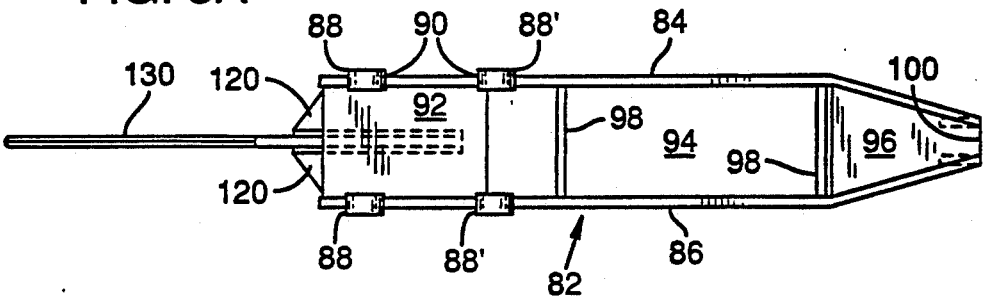
FIGS. 3A and 3B illustrate the attachment of the present invention installed on the machine of FIG. 2.
Figure 3B:
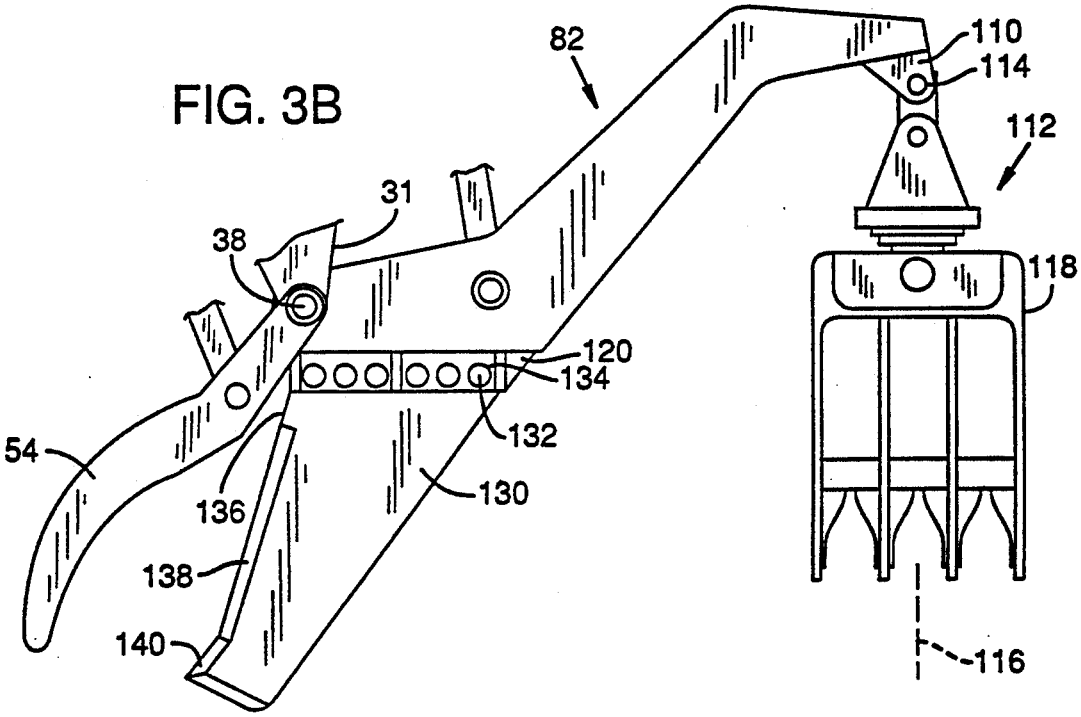

Refer now to FIG. 2 of the drawings which illustrates the machine of FIG. 1 with the bucket 36 removed and with an attachment 80 of the present invention pivotally installed on the end of the articulated boom 12 on shaft 38. A member such as a log 170 is shown being positioned by the machine 10. A log 170 is shown for the purpose of illustration however this member may be a variety of different kinds of members such as stumps, timbers, construction materials and the like. The attachment 80 is pivoted on the end 31 of the beam 30 by cylinder 40. As shown, the cylinder 40 has one end pivotally connected to the beam 30 and the opposite end pivotally connected to shaft 48. Ends of paired control arms 44, 46 are mounted on the shaft 48. A control arm 44 is provided on each end of the shaft 48 and thus on each side of the beam 30 with the opposite ends of control arms 44 pivotally mounted on each side of the beam 30 on shaft 50. A control arm 46 is provided at each end of the shaft 48 with the opposite ends of control arms 46 pivotally mounted at each side of the attachment 80 on shaft 52. The attachment 80 is thus pivoted on the shaft 38 o end 31 of the beam 30 by extension and retraction of the cylinder 40. The attachment 80 is further illustrated in FIGS. 3A and 3B. A structural support 82 of the attachment 80 is configured to be pivotally mounted on shaft 38. The structure 82 is fabricated as by welding. The support 82 has side walls 84, 86 in a spaced relation to receive therebetween the end 31 of the beam 30. To facilitate mounting the attachment 80 on the end of the beam 31, the side walls 84, 86 have bushings 88 fitted in bores 90 with the bushings 88 sized to receive the shaft 38. Another set of bushings 88' are provided in another set of bores 90 in the side walls 84, 86. The bushings 88' receive the shaft 52 on which the ends of the control arms 46 of the machine 10 are pivotally mounted, with one control arm 46 adjacent wall 84 and the other control arm 46 adjacent wall 86. The side walls 84, 86 are fixedly joined by bottom walls 92, 94 and 96. Cross rails 98 and 100 joined to the side and bottom walls are provided for added strength and rigidity. A bracket 110 is provided on the end of the support 82 as shown for mounting a known grapple 112 on shaft 114. The grapple 112 has opposed moveable grappling jaws 118 for grappling material in a conventional manner with the jaws 118 being rotatable about axis 116. Known hydraulic circuitry coupled to the power unit 70 is provided on the machine 10 to provide motive power to the grapple 112. Blade brackets 120 extending from wall 92 are provided to support and hold a splitter blade 130. The blade 130 is removably mounted to the brackets 120 by bolts 132 fitting in mateable bores provided in the brackets 120 and the blade 130 with the bolts 132 being secured by nuts 134. The blade 130 is a shaped elongate flat plate member that extends from bottom 92 when installed on the structure 82. The blade 130 has a beveled knife edge 138 that extends substantially along the length of the front edge 136 including the angled toe portion 140. The attachment 80 mounted on the machine 10 provides the capability of splitting logs, handling logs and splitting, slicing other wood debris.

Figure 4:
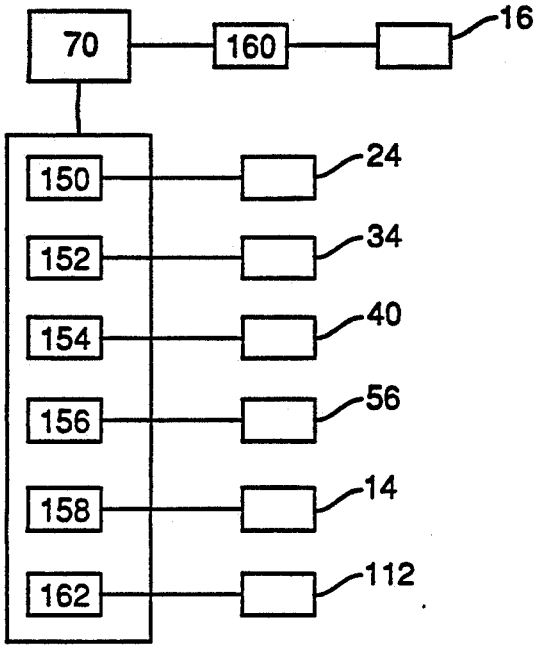
FIG. 4 is a block diagram of the control sets for controlling the functions of the machine of FIG. 2.

As previously mentioned, the components of the machine 10 are controlled by control sets operable by the operator at the control station 15. Referring to FIG. 4, the power unit 70 supplies motive power for operation of the components of the machine 10. A control set 150 is provided to control the cylinders 24 (the cylinders 24 pivot the beam 20 of the boom 12 relative to the base 14), a control set 152 is provided to control cylinder 34 (the cylinder 34 pivots the beam 30 relative to beam 20 of the boom 12), a control set 154 is provided to control cylinder 40 (the cylinder 40 pivots the attachment 80 about its pivotal mount and other attachments mounted in its stead such as bucket 36), a control set 156 is provided to control cylinder 56 (cylinder 56 pivots the heel rack 54 about its pivotal mount), a control set 158 is provided to control the power transmission apparatus that provides rotative movement of the base 14 relative to the carriage 16, a control set 160 is provided to control the carriage 16 (propulsion and steerage) and a control set 162 is provided to control the grapple 112 (rotation of, clamping and unclamping).

Figure 5:
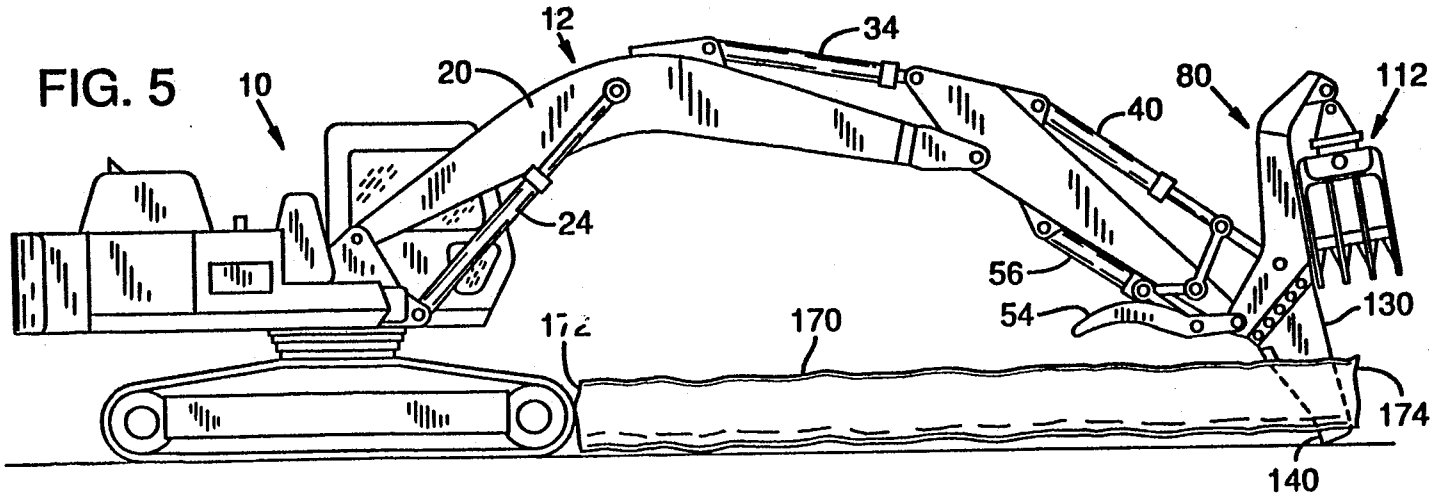
FIG. 5 is a view of the machine of FIG. 2 in the process of splitting a log with the attachment of the present invention.
Figure 6:
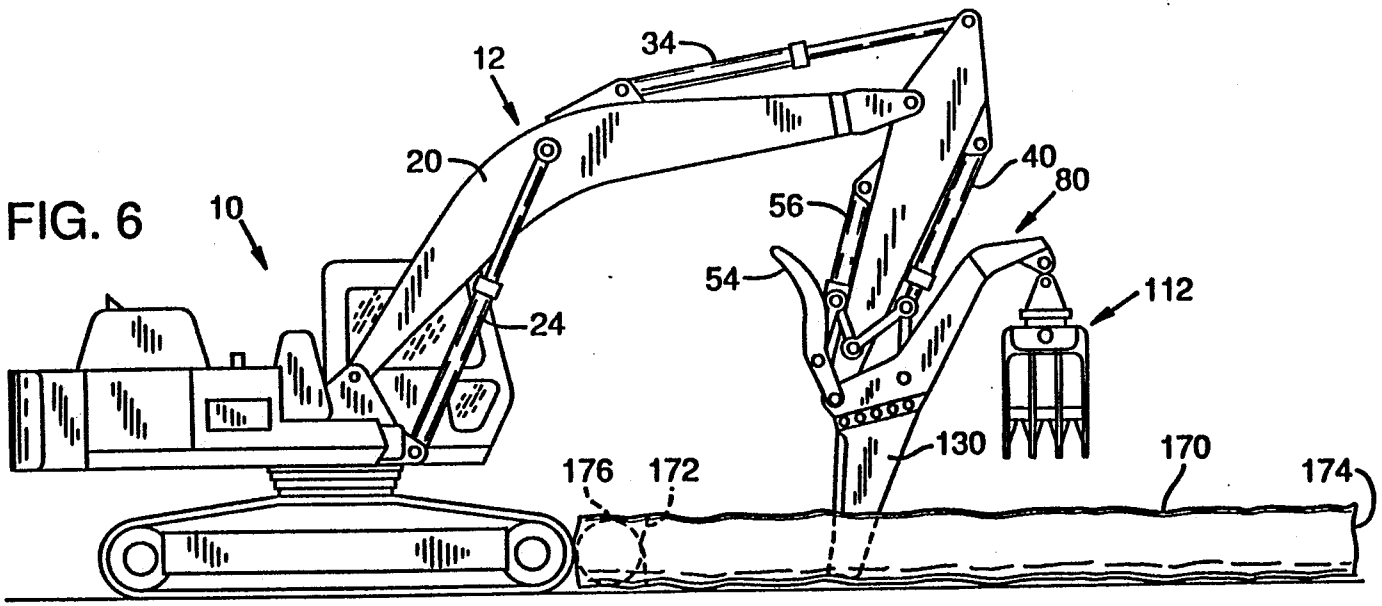
FIG. 6 is another view of the machine of FIG. 2 showing the progression of the attachment of the present invention as the log is being split; and, FIG. 7 is a view of the machine of FIG. 2 in the process of grappling and slicing a log.

Refer now to FIG. 2 of the drawings. The machine 10 with the attachment 80 is positioning a log 170 relative to the machine 10 so that it may be split along its longitudinal length by the blade 130 of the attachment 180. The capability of the machine 10 to extend and retract, elevate and lower the boom 12 and move the boom by rotation of the base 14 on the carriage 16 enables retrieval of logs from stockpiles placed in the vicinity of the machine 10. The log 170 is gripped by the grapple 112 and is elevated by elevating the boom 12. The log 170 is most often gripped by the grapple 112 at a position that is offset from the center of gravity. The log will thus tend to pivot the grapple 112 with the log coming into contact with the heel rack 54 and/or the blade 130. This feature permits gripping the log nearer one of its ends for ease of placement. The log 170 is positioned by manipulation of the machine 10 with the log being placed with one end 172 in abutment with one of the tracks 17 (see FIG. 5). Alternatively, another log 176 (shown in dashed outline in FIG. 6) may be placed transverse to and in front of the tracks 17. Log 170 is then placed with the end 172 in abutment with the log 176. In either case the log 170 is placed so that it extends outwardly away from the machine with the boom 12 basically aligned with the longitudinal axis of the log 170. The grapple 112 is released and the boom 12 is extended outwardly over the log 170 and lowered with the blade 130 coming into contact with the extended end 174 of the log. The toe 140 of the blade being at an angle to the edge 136 facilitates the initial splitting action by the blade 130. With the blade 130 in contact with the end of the log 170, the boom 12 is retracted toward the machine to force the blade through the log 170, thus splitting the log into two longitudinal pieces. FIG. 5 shows the blade 130 as it is entering the end 174 of the log 170 to start the splitting process. As the boom 12 is retracted further toward the machine 10 (one position being illustrated in FIG. 6), the attachment 80 may be pivoted to position the blade 130 at a near normal attitude to the longitudinal axis of the log 170. The beveled edge 138 on the blade 130 provides a wedge to facilitate splitting the log 170. The operation is repeated until the log has been split into multiple longitudinal pieces of the desired dimensions. The split longitudinal pieces of the log 170 are grappled by the grapple 112 and are moved to an area such as a stockpile by manipulation of the machine 10.

Figure 7:
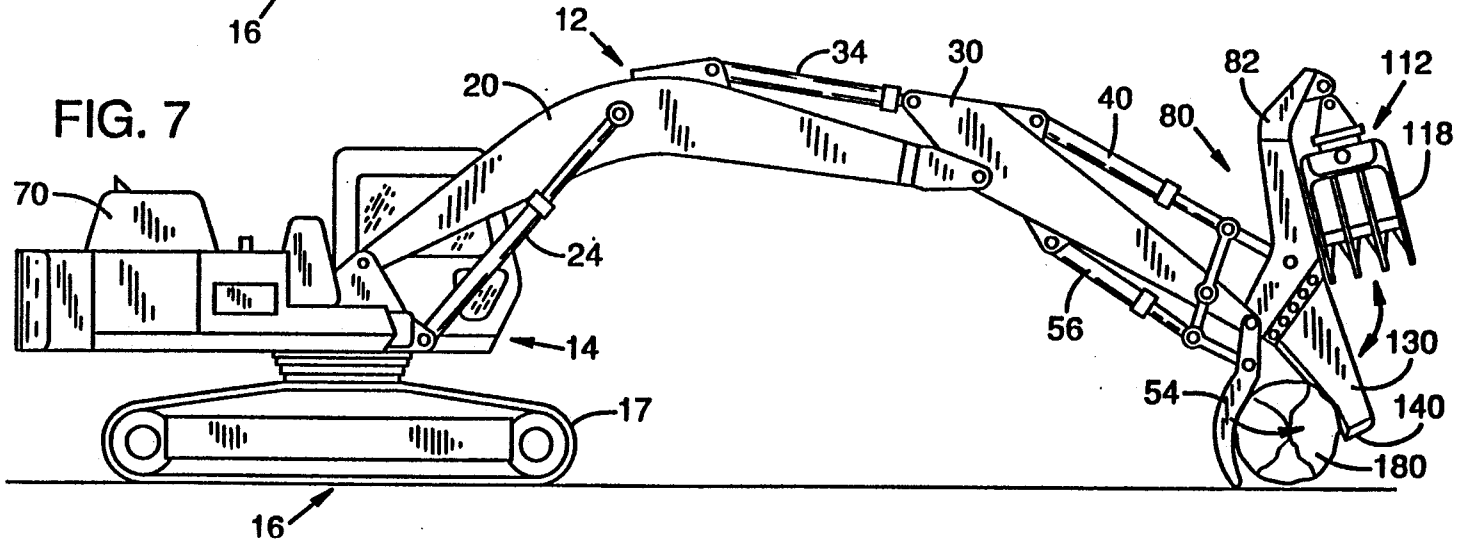

Referring now to FIG. 7, the heel rack 54 and the blade 130 of the attachment 80 are used in combination as a grappling device and as a slicing or cutting device. As shown, a member such as a log 180 is gripped between the heel rack 54 and the blade 130 of the attachment 80. The angled toe portion 140 of the blade 130 provides a projection to aid in gripping the log 180. To cut the log 180, the heel rack 54 and the blade 130 are pivoted toward each other. The heel rack 54 may be pivoted toward the blade 130, the blade 130 may be pivoted toward the heel rack 54 or the pivoting movement toward each other may be accomplished by the simultaneous pivoting movement of both the heel rack 54 and the blade 130

The attachment 80 mounted on the machine 10 is a versatile tool for reducing the size of members, such as by splitting and cutting. It will be appreciated that the attachment 80 is not limited to the processing of logs which are illustrated by way of example. The attachment 80 may be utilized in many other areas where reduction in the size of members is desired or required.

Those skilled in the art will recognize that modifications and variations may be made without departing from the true spirit and scope of the invention. The invention is therefore not to be determined from the appended claims.

What is claimed is:

1. A splitter for splitting members comprising:

a base portion, an articulated boom having one end connected to the base portion and an opposite end that is extendable away from and retractable toward said base portion through articulation of said boom, a first control set for controlling the articulation of said boom, and an attachment attached to said opposite end of said boom, a blade provided by said attachment, said blade having a rearwardly directed cutting edge whereby through manipulation of the articulated boom, a member engaged by said blade can be severed, a rotatable grapple provided by said attachment independent of said blade, and a second control set to selectively manipulate the grapple and blade as desired for positioning and then splitting of a log.

2. A log splitter for lengthwise splitting of full length logs comprising;

a base portion, an articulated boom having one end connected to the base portion and an opposite end that is extendable away from nd retractable toward said base portion through articulation of said boom, a first control set for controlling the articulation of said boom, and an attachment attached to said opposite end of said boom, a blade portion of said attachment including a blade, a grapple portion of said attachment including a grapple for grasping and manipulating a log, said blade having a rearwardly directed cutting edge whereby through retraction of the articulated boom, a log positioned under and along the length of the boom can be hooked by said blade and split lengthwise.

3. A log splitter as defined in claim 2 including a mounting for said articulated boom that permits rotative movement of said boom in a horizontal plane, and a second control set for controlling said rotative movement of said boom.

4. A log splitter as defined in claim 2 wherein said grapple is rotatable for grappling and rotatably positioning a log relative to said boom.

5. A log splitter as defined in claim 2 wherein the blade and grapple are cooperatively arranged on said attachment whereby a forward edge of the blade performs a heeling function for heeling a log that is grappled behind the center of gravity of the log.

6. A log splitter as defined in claim 5 wherein a third control set controls manipulation of said blade, said grapple and said heel member relative to said opposite end of the boom.

7. A log splitter as defined in claim 6 wherein a heel member is provided by said attachment, said heel member being pivotal relative to said blade and opens and closes relative to said blade edge controlled by said third control set, whereby said attachment can be manipulated sideways relative to said log length and through manipulation of said heel member and blade, the log can be cut to length.

* * * * *